US008717394B2

(12) United States Patent
Morgan et al.

(10) Patent No.: US 8,717,394 B2
(45) Date of Patent: May 6, 2014

(54) BOUNDARY DISPERSION FOR MITIGATING PWM TEMPORAL CONTOURING ARTIFACTS IN DIGITAL DISPLAYS

(75) Inventors: Daniel J. Morgan, Denton, TX (US); Gregory J. Hewlett, Richardson, TX (US); Peter F. vanKessel, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 825 days.

(21) Appl. No.: 12/176,728

(22) Filed: Jul. 21, 2008

(65) Prior Publication Data

US 2009/0021540 A1 Jan. 22, 2009

Related U.S. Application Data

(62) Division of application No. 09/088,674, filed on Jun. 2, 1998, now Pat. No. 7,403,213.

(60) Provisional application No. 60/048,588, filed on Jun. 4, 1997.

(51) Int. Cl.
*G09G 5/10* (2006.01)
*G09G 5/02* (2006.01)

(52) U.S. Cl.
USPC ..... 345/691; 345/692; 345/693

(58) Field of Classification Search
USPC ..... 345/691, 692, 693, 63, 214; 348/797
See application file for complete search history.

(56) References Cited

U.S. PATENT DOCUMENTS

| | | | | |
|---|---|---|---|---|
| 4,742,558 | A | 5/1988 | Ishibashi et al. | |
| 4,992,781 | A | 2/1991 | Iwasaki et al. | |
| 5,029,107 | A | 7/1991 | Lee | |
| 5,053,764 | A | 10/1991 | Barbier et al. | |
| 5,126,843 | A | 6/1992 | Tanaka | |
| 5,196,839 | A | 3/1993 | Johary et al. | |
| 5,254,979 | A | 10/1993 | Trevett et al. | |
| 5,309,551 | A | 5/1994 | Guttag et al. | |
| 5,488,421 | A | 1/1996 | Hwang et al. | |
| 5,528,313 | A | 6/1996 | Tanaka et al. | |
| 5,543,819 | A | 8/1996 | Farwell et al. | |
| 5,686,939 | A | 11/1997 | Millward et al. | |
| 5,731,802 | A | 3/1998 | Aras et al. | |
| 5,784,055 | A | 7/1998 | Ngai | |
| 5,812,112 | A | 9/1998 | Helfferich | |
| 5,821,915 | A | 10/1998 | Graham et al. | |
| 5,886,682 | A | 3/1999 | Biggs | |
| 5,917,504 | A | 6/1999 | Yutaka et al. | |
| 5,953,002 | A | 9/1999 | Hirai et al. | |
| 5,963,261 | A | 10/1999 | Dean | |
| 5,995,163 | A | 11/1999 | Fossum | |
| 6,020,869 | A | 2/2000 | Sasaki et al. | |
| 6,025,818 | A * | 2/2000 | Okano | 345/214 |

(Continued)

*Primary Examiner* — Kevin M Nguyen
(74) *Attorney, Agent, or Firm* — Warren L. Franz; Wade J. Brady, III; Frederick J. Telecky, Jr.

(57) ABSTRACT

A method and system providing boundary dispersion to pixel values displayed on a binary spatial light modulator to reduce temporal contouring artifacts. Pixel code values are offset from a nominal value when displayed on the SLM to disperse a large bit transition for a pulse width modulation (PWM) system. The offset value varies as a function of the pixel digital code, the pixel spatial location on the screen, and pixel temporal location in time. The set of offsets applied to pixels is varied over a repeating sequence of 2 displayed frames.

11 Claims, 4 Drawing Sheets

(56) References Cited

U.S. PATENT DOCUMENTS 6,084,561 A 7/2000 Kudo et al.
6,094,187 A 7/2000 Jones et al.
6,219,102 B1 4/2001 Wagner et al.
6,222,515 B1 4/2001 Yamaguchi et al.
6,226,054 B1 5/2001 Morgan et al.
7,403,213 B1 7/2008 Morgan et al.

* cited by examiner

CHECKERBOARD, 50% OF PIXELS USE MSB B5
MIDDLE DENSITY, 25% OF PIXELS USE MSB B5
CHECKERBOARD, 0% OF PIXELS USE MSB B5
FRAME1
FRAME2
20
22
24
[+/−2] 32 = (34+30)/2
[+/−2] 31 = (32+28)/2 +1
[+/−2] 30 = (32+28)/2
[+/−4,+/−2] 29 = (32+24)/2 +1, (30+26)/2 +1
[+/−4,+/−2] 28 = (32+24)/2 , (30+26)/2
[+/−6,+/−2] 27 = (32+20)/2 +1, (28+24)/2 +1
[+/−6,+/−2] 26 = (32+20)/2 , (28+24)/2
[+/−2] 25 = (26+22)/2 +1
[+/−2] 24 = (26+22)/2

BOUNDARY DISPERSION FOR MITIGATING PWM TEMPORAL CONTOURING ARTIFACTS IN DIGITAL DISPLAYS

This application is a divisional of application Ser. No. 09/088,674, filed Jun. 2, 1998, which claims the benefit of provisional Application No. 60/048,588, filed Jun. 4, 1997.

CROSS REFERENCE TO RELATED APPLICATIONS

Cross reference is made to the following co-pending patent applications, each being assigned to the same assignee as the present invention and the teachings included herein by reference:

| SERIAL NUMBER | TITLE | FILING DATE |
|---|---|---|
| 08/725,719 | METHOD TO REDUCE PERCEPTUAL CONTOURING IN DISPLAY SYSTEMS | Oct. 4, 1996 |
| TI-25996 (Attorney's Docket #) | GLOBAL LIGHT BOOST FOR PULSE WIDTH MODULATION DISPLAY SYSTEMS | HEREWITH |

FIELD OF THE INVENTION

The present invention relates generally to digital video display systems, and more particularly to digital display systems utilizing bit-planes for performing pulse width modulation to display digital video data.

BACKGROUND OF THE INVENTION

Binary spatial light modulators are typically comprised of an array of elements each having two states, on and off. The use of pulse width modulation (PWM) is one conventional approach of digitally displaying incoming analog video data, as compared to an analog display such as a cathode ray tube (CRT) based system. PWM typically comprises dividing a frame of incoming video data into weighted segments. For example, for a system that samples the luminance component of incoming video data in 8-bit samples, the video frame time is divided up into 255 time segments or pixel values ($2^8-1$). Conventionally, the 8-bit samples are formatted with binary values. The most significant bit (MSB) data is displayed on a given element for 128 time segments. In the present example, the next MSB has a time period of 64 time segments, and so on, such that the next bits have weights of 32, 16, 8, 4, 2 and 1 time segments, consecutively. Thus, the least significant bit (LSB) has only one time segment. All pixel values are comprised of a summation of these weighted bits.

In DMD display systems, such as disclosed in commonly assigned U.S. Pat. No. 5,278,652 entitled "DMD Architecture and Timing for Use in a Pulse-Width Modulated Display System", the teachings of which are incorporated herein by reference, light intensity for each pixel is typically displayed as a linear function of the pixel digital codes. For an 8-bit binary code, 0 is no light, 255 is peak light, and 128 is midscale light. Codes between 0 and 255 form a grayscale in each color. This grayscale sets the image resolution for the system by defining the number of discrete levels of light that can be produced for each color; i.e. red, green and blue. Pulse width modulation (PWM) schemes used to control the mirrors conventionally modulate the mirrors using bit-planes having weights based on powers of two. For example, 20 μs, 40 μs, 80 μs, 160 μs, 320 μs, 640 μs, 1280 μs, and 2,560 μs are used to define the mirror on-times for the 8 bit-planes needed for 8-bit video where 5.5 ms is available per color. Light is transmitted to the display screen as black for the bit-plane of a pixel which is logic 0 or at full brightness during a bit-plane which is logic 1. Since the on-times for bit-planes vary, this results in PWM over a frame period. The viewer's eyes integrate the modulated light so that gray levels are formed and perceived.

A problem arises when using the PWM technique because the light is displayed in series of discrete bursts during each frame. The shifts in ordering of these discrete bursts, as the displayed graycodes vary, generate artifacts in some images. For adjacent pixels, where major bit transitions take place, the sudden change in the ordering (and therefore time phase) of the discrete light burst within a frame causes noticeable pulsations in images upon viewing. Viewer's eyes integrate the out of phase ordering of mirror modulation, for adjacent pixels, to create the pulsations. These pulsations are referred to as PWM temporal contouring (hereafter referred to as simply PWM contouring), shown in FIG. 1, because they create apparent contours in images that are time-varying. In commonly assigned U.S. Pat. No. 5,619,228 entitled "Method for Reducing Temporal Artifacts in Digital Video Systems", there is disclosed one method of mitigating PWM contouring, the teachings of which are incorporated herein by reference.

PWM contouring can most clearly be seen on a grayscale ramp that goes horizontally across the screen. Here, vertical pulsations are seen at many major bit transitions when a viewer's eyes are scanned horizontally across the screen. When a viewer's eyes scan, the eyes integrate light only briefly over any given part of the screen. The viewer's scanning eyes catch the transmitted light for adjacent pixels out of time phase and pulsations are seen on the screen.

At normal viewing distance, PWM contouring for two adjacent pixels is difficult or impossible to resolve. However, in real images, boundary conditions often exists where many pixels are spatially bunched together with codes near each other (a sky scene for example). If these codes have clusters that cross a major bit transition, while others don't, PWM contouring will occur.

It is desirable to display data on a digital display, such as a DMD, with reduced PWM contouring artifacts without increasing system bandwidth.

SUMMARY OF THE INVENTION

The present invention achieves technical advantages by using boundary dispersion to selectively offset nominal pixel values alternately between a positive offset and a negative offset, repeatedly over a sequence of 2 displayed frames, whereby the average value of the two offset values over 2 displayed frames, as seen by the viewer, is equal to the nominal pixel value. For purpose of clarity the two frame sequence described below refers to two subsequent frames of source video data; however, the sequence can also be comprised of subframes within one frame of source video data. The chosen offset varies as a function of the nominal pixel value, the pixel spatial location on the screen, and pixel temporal location in time. The set of offsets applied to pixel values is varied over a successive 2-frame sequence. Selected offsets are applied to pixel values within each frame as a function of spatial location on the DMD, and which of the 2 frames is being displayed. Within one frame, any given pixel value is offset by some amount above its correct value, and offset the same amount below its normal value in the next frame. Alternatively, the given pixel value is offset below its normal value in the first frame, and then offset above its normal value in the next frame. In either case, the average pixel value over the 2 frames, as perceived by the viewer, is equal to the nominal pixel value. The same is true of all pixels displayed on the DMD where an offset is used.

Boundary dispersion offsets certain pixel values from their nominal values in each frame according to preplanned spatial patterns. The spatial pattern used is dependent upon the value of the pixel codes. In each spatial pattern, some pixel values get a positive offset and some get a negative offset. In the next frame, an inverse set of offsets is used so that all pixels average to their nominal values over the consecutive 2-frame sequence.

A cluster of pixel codes at or near the transition of a major bit (e.g. 8, 16, 32, 64, 128) uses the offsets so that some pixels have a major bit set, and some do not. Adjacent clusters of pixels, where one cluster contains pixels below the major bit and others contain pixels above the major bit, have the bit transition boundary dispersed. PWM contouring reduction is the result. The offsetting of some pixels positively and some negatively in any given frame according to the spatial pattern also prevents any potential flicker artifacts that may be introduced by offsetting pixel codes over 2 frames.

A checkerboard pattern for a 2-frame sequence is one predefined pattern used to a disperse bit transition spatially around a bit transition boundary, for instance, the bit B5, which corresponds to the value of 32. Areas of the screen around this bit transition, for instance, codes 26 through 29, use more complex 2-frame patterns. The added complexity of these patterns is needed to control the density of pixels that have a major bit, i.e. B5, set in any given frame. A balance is struck between reducing PWM boundary artifacts and new artifacts introduced within a spatial area having a given code. This is because if too many (or too few) pixels have the major bits set, i.e. B5, within an area using a given code, temporal noise can result in this area. The patterns are properly defined so that the contouring artifacts within a code (intra-code) are much less objectionable than the major bit transition boundaries (inter-code boundaries). By use of a particular pattern, for instance the checkerboard pattern, the spatial patterns having pixels with and without the major bits set are packed so spatially tightly that the intra-code contouring is not resolvable by a viewer at normal viewing distance. Since the PWM contouring is dispersed over a larger area, the overall temporal artifacts seen in the image are greatly reduced.

DESCRIPTION OF THE PREFERRED EMBODIMENT

Figure 1:
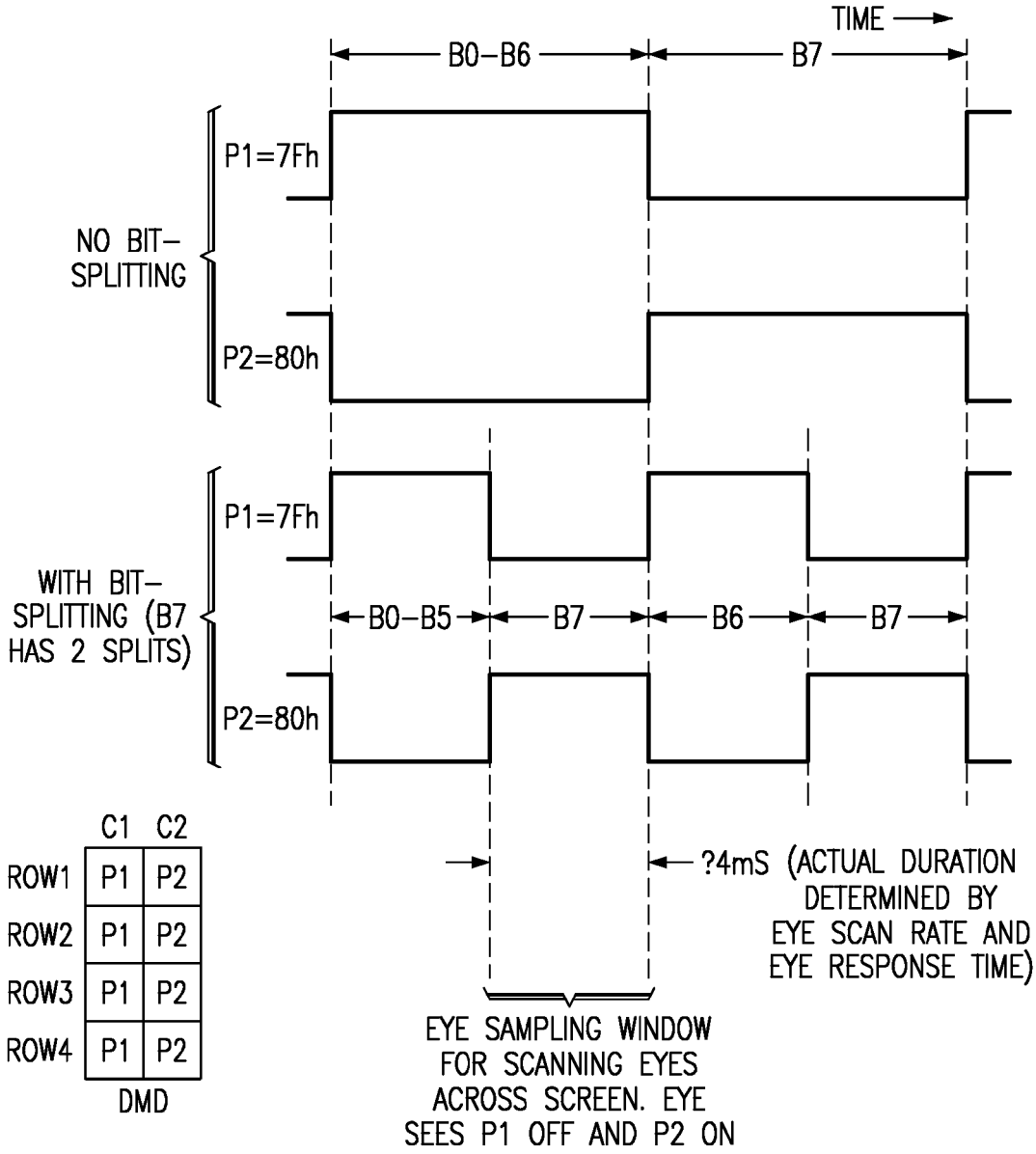
FIG. 1 is an illustration of the source of PWM temporal contouring.
Figure 2:
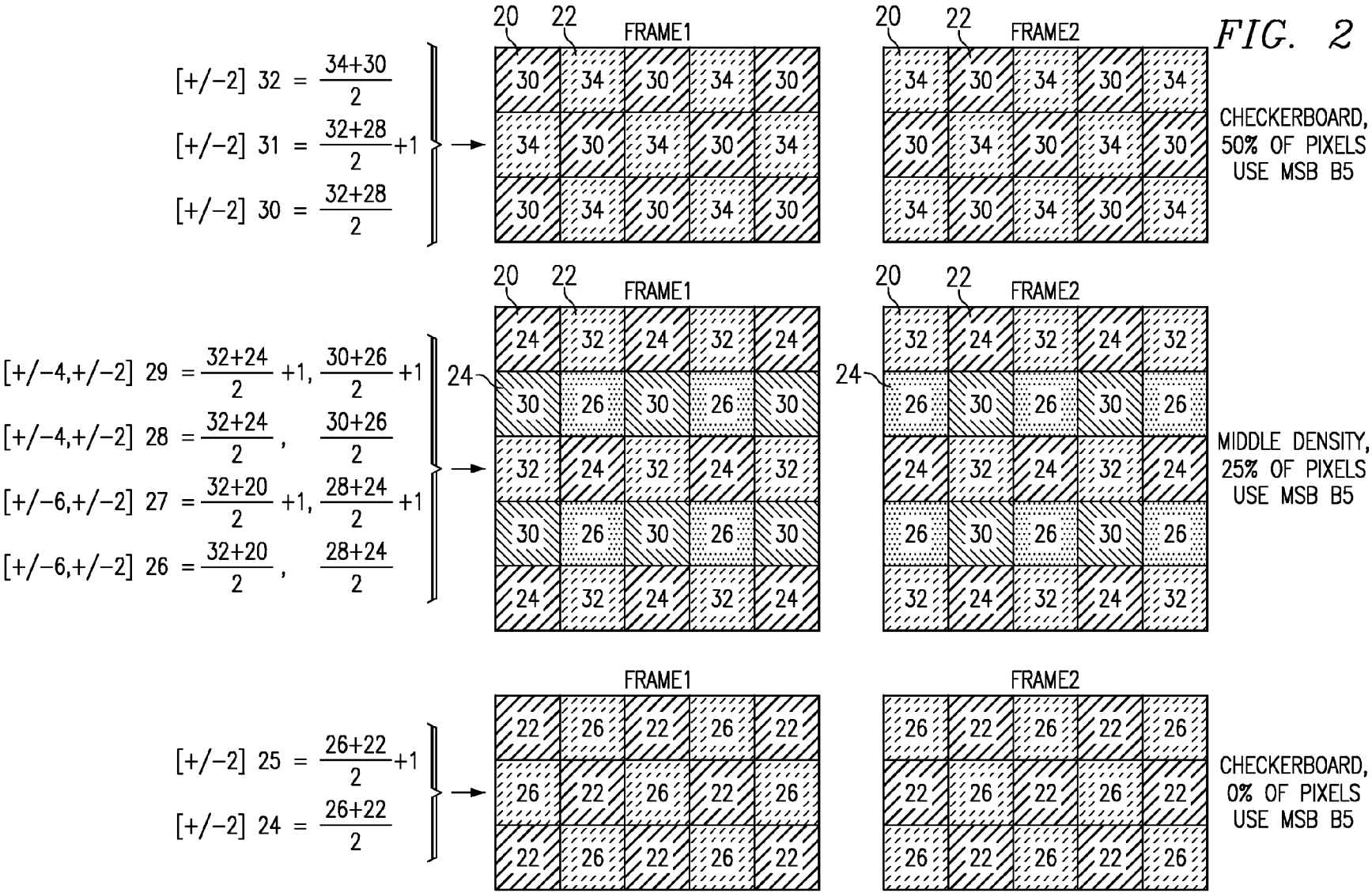
FIG. 2 is an illustration of the PWM temporal contouring reduction using boundary dispersion according to the preferred embodiment of the present invention, whereby a checkerboard pattern is utilized to disperse a major bit transition, such as the B5 bit transition, spatially around the major bit transition boundary.

Referring now to FIG. 2, there is illustrated PWM temporal contouring reduction using boundary dispersion according to the preferred embodiment of the present invention. Many of the pixel code values input to the DMD formatting electronics are offset from their nominal values when displayed on the DMD. The offset varies as a function of the pixel digital code, the pixel spatial location on the screen, and pixel temporal location in time. The set of offsets applied to pixel values is varied over a successive 2-frame sequence. Selected offsets are applied to pixels within each frame as a function of spatial location on the DMD and which of the 2 frames is being displayed.

Within one frame, any given pixel is offset by some amount above or below its correct value, and offset below or above, respectively, its normal value in the next frame. The average value over the 2 frames, as seen by the viewer, is equal to the nominal pixel value. The same is true of all pixels displayed on the DMD where an offset is used.

Boundary dispersion offsets pixels from their nominal values in each frame according to preplanned spatial patterns. This spatial pattern used is dependent on the value of the pixel code to disperse the pixels that have a major bit transition. In each spatial pattern, some pixels get a positive offset and some get a negative offset. In the next frame, an inverse set of offsets is used so that all pixels average to their nominal value.

A cluster of pixel codes at or near the transition of a major bit (e.g. 8, 16, 32, 64, 128) will have some pixels with this major bit set, and some without. Adjacent clusters of pixels, where one cluster contains pixel values below the major bit and the other cluster contains pixel values above the major bit have the bit transition boundary dispersed. PWM contouring reduction is the result.

As shown in FIG. 2, there are illustrated spatial patterns implementing boundary dispersion, shown at top for areas of the screen using code 31 or code 32. A 2-frame checkerboard pattern is used to disperse the B5 bit transition spatially around the bit transition boundary. Areas of the screen having codes 26-29 use more complex 2-frame patterns, shown in the middle checkerboard pattern. The added complexity of these patterns is needed to control the density of pixels that have B5 set in any given frame. A balance is struck between reducing PWM boundary artifacts and the new artifacts introduced within a spatial area having a given code. If too many (or too few) pixels have B5 set within an area using a given code, temporal noise can result in this area. This temporal noise is actually a form of PWM contouring, except now the contouring occurs on the screen within areas having the same pixel codes, rather than at major bit boundaries between clusters of pixels on the screen.

Since the patterns are properly defined, the contouring artifacts within a code (intra-code) are much less objectionable than at major bit transition boundaries (inter-code). In fact, for most patterns (like the checkerboard pattern) the spatial patterns having the pixels with and without the major bit set are packed so tightly that the intra-code contouring is not resolvable by a viewer at normal viewing distance. The fact that adjacent pixels have transmitted light out of time phase cannot be resolved.

As illustrated in FIG. 2, the transition between codes 31 and 32 has the PWM contouring at this boundary dispersed to within codes 31 and 32 rather than having a clearly defined boundary. Since the PWM contouring is dispersed over a larger area, the overall temporal artifacts seen in the image are greatly reduced.

Figure 3:
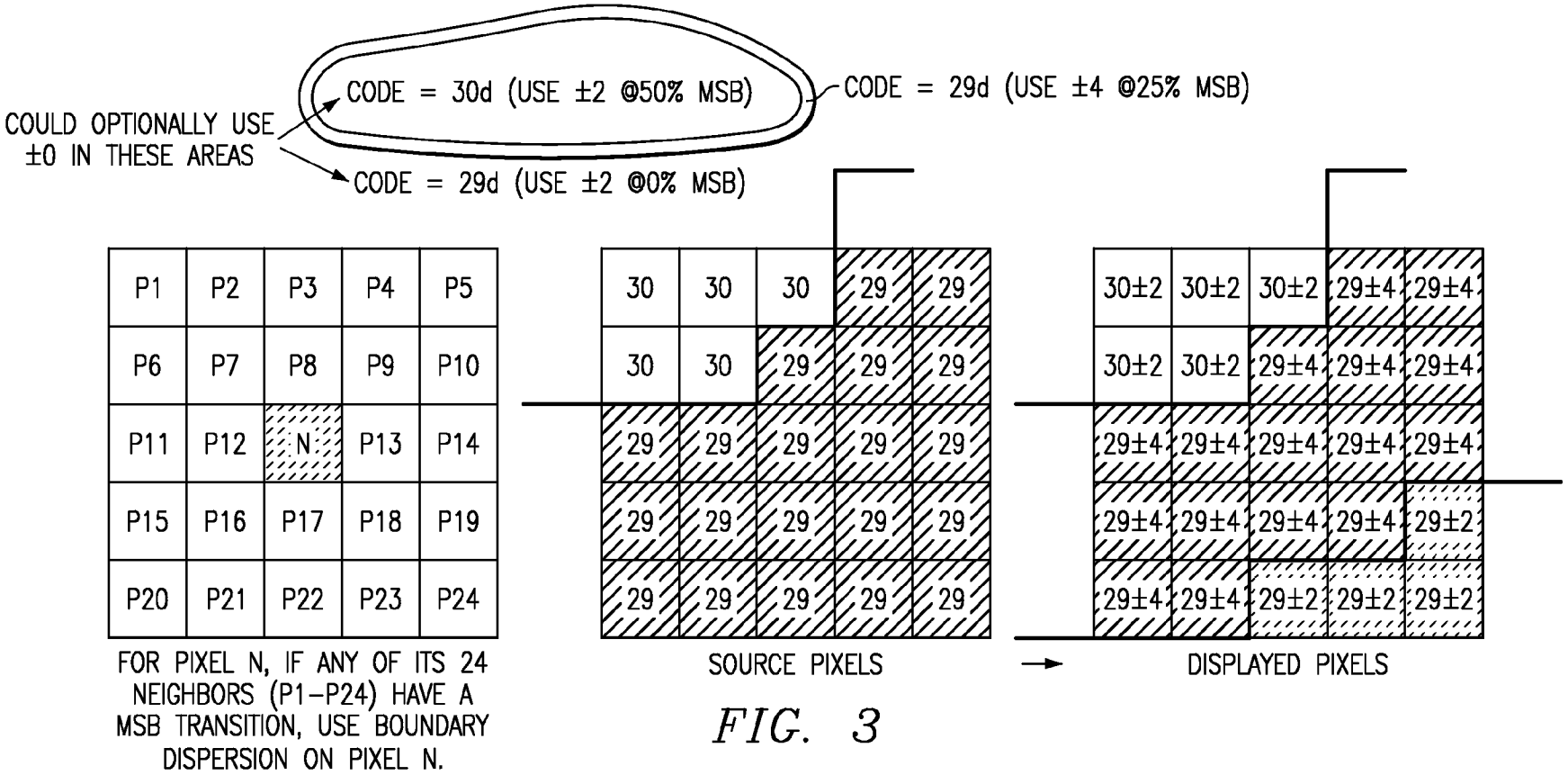
FIG. 3 is an illustration of an adaptive version of the algorithm of the present invention that employs spatial patterns at and near areas of the screen having major bit transitions, whereby large clusters of pixel values interface one another along a boundary.

FIG. 3 illustrates an adaptive version of the algorithm that only employs the spatial patterns at and near areas of the screen having major bit transitions. This approach allows for any intra-code artifacts created by the present invention to be eliminated for areas of the screen not needing boundary dispersion invoked.

Referring back to FIG. 2, it can be seen that for other pixel values further away from the transition boundary, such as pixel values 26, 27, 28 and 29, using boundary dispersion sets the major bit during one frame but not the next frame to help control the density of pixels that have B5 set in any given frame. For a pixel code of 29, for instance, a pixel code of 33 (29+4) is displayed during frame 1, with a pixel code of 25 (29−4) being displayed in frame 2. For a pixel code of 27, a pixel code of 33 (27+6) is displayed during the first frame, with a pixel code of 21 (27−6) being displayed the next frame. Thus, a major bit is set one frame, but not the next.

As shown in FIG. 2, the checkerboard pattern takes into account the spatial location of the pixels in the display. For instance, for a pixel identified at 20 in row 1 column 1, the lower value is displayed during frame 1, and the higher value is displayed in frame 2. For an adjacent pixel, such as the pixel identified at 22 in row 1 column 2, the higher value is displayed during frame 1 and the lower value is displayed in frame 2. Again, the average over this 2-frame sequence is the nominal pixel value.

Still referring to FIG. 2, to display a pixel value of 28, for instance, 25% of the pixels are set up to use the MSB B5. As shown, every other row of pixels utilizes the MSB B5 in one frame, and not the next. In row 2 and row 4, for instance, the MSB is never used, although the pixel value is offset a lower amount i.e. +/−2, for these rows to help minimize temporal contouring. For instance, pixel 24 will have a value of 30 during frame 1, and 26 the next frame. The adjacent pixel in row 2 column 2, however, will have the lower value of 26 during frame 1 and the higher value of 30 the next frame. In either instance, pixel 24 never has the MSB B5 set. The MSB is only set in the odd rows of pixels for pixel values that are closer to a bit transition, i.e. 26, 27, 28, and 29.

For even lower values of pixel codes that are further away from a bit transition, i.e. pixel codes 24 and 25, none of the pixels use the MSB B5, however, the value of the pixel code is dithered from frame to frame slightly, i.e. + or −2, to help achieve acceptable temporal contouring mitigation.

Referring again to FIG. 3, there is shown how a section or cluster of pixels is displayed as a function of the source pixels for the same cluster. If there is a boundary defined by a cluster of pixel values, i.e. 29 and 30, using the boundary dispersion process of the present invention the pixel values of 30 will be offset either +2 or −2, depending on the frame being displayed. However, the pixel values of 29 will be offset either +4 or −4, depending upon the frame being displayed. Again, this allows the MSB B5 to be displayed, in this case, 50% of the time. FIG. 3 illustrates the algorithm whereby for a pixel "N", if any of the 24 neighbors of pixel N (P1-P24) have an MSB transition, the boundary dispersion is performed on pixel N to achieve PWM temporal contouring.

Referring now to Table 1 below, there is shown one preferred approach of providing boundary dispersion for the whole set of pixel codes between 0 and 255 to help disperse a major bit transition spatially around the bit transition boundaries.

TABLE 1

| Code | Offsets | Pattern Type |
|---|---|---|
| 255 | +/−0 | None |
| 254 | +/−0 | None |
| 253 | +/−2 | Checkerboard |
| 252 | +/−2 | Checkerboard |
| 251 | +/−2 | Checkerboard |
| 250 | +/−2 | Checkerboard |
| 249 | +/−2 | Checkerboard |
| 248 | +/−2 | Checkerboard |
| 247 | +/−2 | Checkerboard |
| 246 | +/−2 | Checkerboard |
| 245 | +/−6, +/−2 | 25% Crossing |
| 244 | +/−6, +/−2 | 25% Crossing |
| 243 | +/−4, +/−2 | 25% Crossing |
| 242 | +/−4, +/−2 | 25% Crossing |
| 241 | +/−2 | Checkerboard |
| 240 | +/−2 | Checkerboard |
| 239 | +/−2 | Checkerboard |
| 238 | +/−2 | Checkerboard |
| 237 | +/−4, +/−2 | 25% Crossing |
| 236 | +/−4, +/−2 | 25% Crossing |
| 235 | +/−6, +/−2 | 25% Crossing |
| 234 | +/−5, +/−2 | 25% Crossing |
| 233 | +/−2 | Checkerboard |
| 232 | +/−2 | Checkerboard |
| . | | |
| . | | |
| . | | |
| 73 | +/−2 | Checkerboard |
| 72 | +/−2 | Checkerboard |
| 71 | +/−2 | Checkerboard |
| 70 | +/−2 | Checkerboard |
| 69 | +/−6, +/−2 | 25% Crossing |
| 68 | +/−6, +/−2 | 25% Crossing |
| 67 | +/−4, +/−2 | 25% Grossing |
| 66 | +/−4, +/−2 | 25% Crossing |
| 65 | +/−2 | Checkerboard |
| 64 | +/−2 | Checkerboard |
| 63 | +/−2 | Checkerboard |
| 62 | +/−2 | Checkerboard |
| 61 | +/−4, +/−2 | 25% Crossing |
| 60 | +/−4, +/−2 | 25% Crossing |
| 59 | +/−6, +/−2 | 25% Crossing |
| 58 | +/−6, +/−2 | 25% Crossing |
| 57 | +/−2 | Checkerboard |
| 56 | +/−2 | Checkerboard |
| 55 | +/−2 | Checkerboard |
| 54 | +/−2 | Checkerboard |
| 53 | +/−6, +/−2 | 25% Crossing |
| 52 | +/−6, +/−2 | 25% Crossing |
| 51 | +/−4, +/−2 | 25% Crossing |
| 50 | +/−4, +/−2 | 25% Crossing |
| 49 | +/−2 | Checkerboard |
| 48 | +/−2 | Checkerboard |
| 47 | +/−2 | Checkerboard |
| 46 | +/−2 | Checkerboard |
| 45 | +/−4, +/−2 | 25% Crossing |
| 44 | +/−4, +/−2 | 25% Crossing |
| 43 | +/−6, +/−2 | 25% Crossing |
| 42 | +/−6, +/−2 | 25% Crossing |
| 41 | +/−2 | Checkerboard |
| 40 | +/−2 | Checkerboard |
| 39 | +/−2 | Checkerboard |
| 38 | +/−2 | Checkerboard |
| 37 | +/−6, +/−2 | 25% Crossing |
| 36 | +/−6, +/−2 | 25% Crossing |
| 35 | +/−4, +/−2 | 25% Crossing |
| 34 | +/−4, +/−2 | 25% Crossing |
| 33 | +/−2 | Checkerboard |
| 32 | +/−2 | Checkerboard |
| 31 | +/−2 | Checkerboard |
| 30 | +/−2 | Checkerboard |
| 29 | +/−4, +/−2 | 25% Crossing |
| 28 | +/−4, +/−2 | 25% Crossing |

TABLE 1-continued

| Code | Offsets | Pattern Type |
|---|---|---|
| 27 | +/−6, +/−2 | 25% Crossing |
| 26 | +/−6, +/−2 | 25% Crossing |
| 25 | +/−2 | Checkerboard |
| 24 | +/−2 | Checkerboard |
| 23 | +/−2 | Checkerboard |
| 22 | +/−2 | Checkerboard |
| 21 | +/−6, +/−2 | 25% Crossing |
| 20 | +/−6, +/−2 | 25% Crossing |
| 19 | +/−4, +/−2 | 25% Crossing |
| 18 | +/−4, +/−2 | 25% Crossing |
| 17 | +/−2 | Checkerboard |
| 16 | +/−2 | Checkerboard |
| 15 | +/−2 | Checkerboard |
| 14 | +/−2 | Checkerboard |
| 13 | +/−2 | Checkerboard |
| 12 | +/−2 | Checkerboard |
| 11 | +/−2 | Checkerboard |
| 10 | +/−2 | Checkerboard |
| 9 | +/−2 | Checkerboard |
| 8 | +/−2 | Checkerboard |
| 7 | +/−2 | Checkerboard |
| 6 | +/−2 | Checkerboard |
| 5 | +/−0 | None |
| 4 | +/−0 | None |
| 3 | +/−0 | None |
| 2 | +/−0 | None |
| 1 | +/−0 | None |
| 0 | +/−0 | None |

The larger the pixel value, the more pixel codes adjacent this boundary that have temporal contouring applied.

Figure 4:
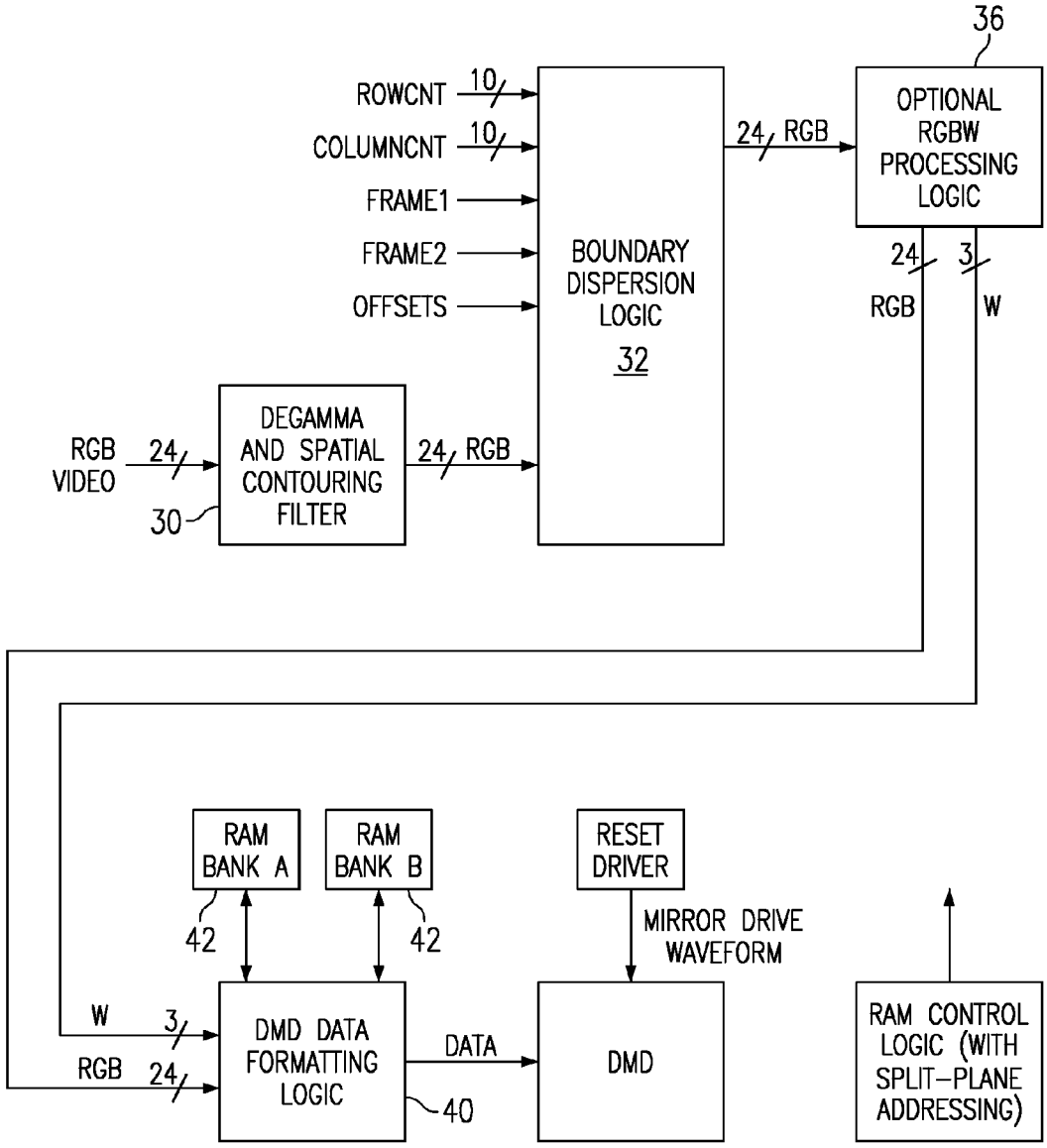
FIG. 4 shows a block diagram for implementing boundary dispersion logic according to the present invention, the boundary dispersion being performed by spatially identifying pixels on the DMD based on row and column, as well as identifying which frame of the 2-frame temporal sequence the pixel value is associated with, i.e. frame 1 or frame 2, whereby the correct offset is added or subtracted to each pixel value in a particular spatial-temporal assignment.

Referring now to FIG. 4, there is shown a block diagram for implementing boundary dispersion logic according to the present invention. 24-bit data (8 bits per color) is the input from the video source. A degamma function 30 is applied to each RGB color so that the DMD display output matches a CRT response. Since the degamma output is limited to 24 bits, a spatial contouring filter is included that diffuses the 8-bit per color quantization errors for low intensity pixels. The boundary dispersion logic 32 according to the present invention accepts the spatial contouring filter output. The boundary dispersion logic 32 receives signals to identify pixels spatially on the DMD, which signals are provided on signal lines row count ROWCNT and column count COLUMNCNT. A signal is also provided to identify the particular frame of the 2-frame temporal sequence, identified as signal FRAME 1/2. A logic high on this line indicates a FRAME 1, and a logic 0 indicates FRAME 2. The boundary dispersion logic assigns spatial patterns as a function of these signals where offsets are applied to each 8-bit color pixel. The offset values are provided to the boundary dispersion logic 32 so that the correct offset is added or subtracted to each pixel in a particular spatial-temporal assignment, as shown in FIG. 2 and illustrated in Table 1. The offsets and spatial-temporal patterns applied by the boundary dispersion logic 32 are also a function of the pixel codes. Table 1 illustrates this. FIG. 2 illustrates how the boundary dispersion logic is applied to pixels in a spatial-temporal manner.

The 24 signals from the boundary dispersion logic 32 are input into the DMD data formatting logic 40. The DMD data formatting logic organizes the input data into words which form digital planes of information and then loads them into banks of RAM 42. Data is written to one bank of RAM 40 while the other bank is being continuously read and written to the DMD. Thus, a double-buffer memory is used. The buffers are swapped at each VSYNC which indicates a frame boundary for source pixels.

TABLE 2

| | PIXEL VALUE | plus | | | | minus | | | | w/ GB +/− | no GB +/− |
|---|---|---|---|---|---|---|---|---|---|---|---|
| 0000 | 16 | 2 | | | | 2 | | | | 2 | 2 |
| 0001 | 17 | 4 | 7 | 8 | | 8 | 7 | 5 | 4 | 4 | 2 |
| 0010 | 18 | 1 | 2 | 4 | 5 | 4 | | | | 4 | 4 |
| 0011 | 19 | 2 | 5 | 6 | | 5 | | | | 5 | 4 |
| 0100 | 20 | 6 | | | | 6 | | | | 6 | 6 |
| 0101 | 21 | 8 | 11 | 12 | | 12 | 11 | 9 | 8 | 8 | 6 |
| 0110 | 22 | 5 | 6 | 8 | 9 | 8 | | | | 8 | 8 |
| 0111 | 23 | 6 | 9 | 10 | | 9 | | | | 9 | 8 |
| 1000 | 24 | 5 | 8 | 9 | | 9 | 8 | 5 | | 8 | 8 |
| 1001 | 25 | 4 | 7 | 8 | | 8 | 7 | 5 | 4 | 8 | 8 |
| 1010 | 26 | 8 | | | | 9 | 8 | 6 | 5 | 6 | 6 |
| 1011 | 27 | 2 | 5 | 6 | | 5 | | | | 6 | 6 |
| 1100 | 28 | 1 | 4 | 5 | | 5 | 4 | 1 | | 4 | 4 |
| 1101 | 29 | 0 | 3 | 4 | | 4 | 3 | 1 | 0 | 4 | 4 |
| 1110 | 30 | 4 | | | | 5 | 4 | 2 | 1 | 4 | 2 |
| 1111 | 31 | −2 | 1 | 2 | | 1 | | | | 1 | 2 |

Referring now to Table 2, there is shown an alternative embodiment of the present invention to account for any problems that may occur when boundary dispersion according to the present invention is utilized in combination with a global boost algorithm, as disclosed in commonly assigned patent application identified as Ser. No. 09/088,644 entitled "GLOBAL LIGHT BOOST FOR PULSE WIDTH MODULATION DISPLAY SYSTEMS" filed herewith, and the teachings of which are incorporated herein by reference.

An example of a problem occurs when boundary dispersion receives an input pixel value of 17. The boundary dispersion algorithm may perform a +/−2 offset on the 17 and output a 19 one frame and a 15 the other frame according to a checkerboard pattern to traverse the PWM bit boundary. The global boost algorithm, as disclosed in the co-pending patent application, then outputs a (16,16+6) pattern for the 19 value, and an (8+6,16) pattern for the 15 value. The problem is that the output will be (16,16) or (16+6, 8+6) depending upon the phase relationship between the boundary dispersion and the global boost checkerboards. These two patterns yield DC PWM output of (16+16)/2=16 or (22+14)/2=18 depending upon the phase. If it is 16, the output DC PWM has an error of −1 since it should be 17. Furthermore, a DC value of 1 cannot simply be added in global boost or boundary dispersion to offset this error because the result of the +1 will yield other checkerboard conflicts, as well. Note that Table 2, which illustrates codes 16-31 may be repeated to all 256 grayscale shades.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. A method of displaying a sequence of image frames, said method comprising:

providing first values for image pixels of a first image frame;

for the first image frame, offsetting the first values to obtain first display values for the image pixels; the first values being offset by applying a spatial pattern of offsets to the first values of pixels in a spatial cluster of pixels located at or near a major bit transition boundary within the first image plane to spatially disperse the boundary; wherein, in the first image frame, some pixels of the cluster get a positive offset to their first values and other pixels of the cluster get a negative offset to their first values;

displaying said image pixels of the first image frame with the first display values during a display period of the first image frame;

providing second values for the image pixels in a second image frame;

for the second image frame, offsetting the second values to obtain second display values for the image pixels; the second values being offset by applying an inverse of the spatial pattern of offsets to the second values of the pixels in the spatial cluster; wherein, in the second image frame, the some pixels get a negative offset to their second values and the other pixels get a positive offset to their second values; and displaying said image pixels of the second image frame with the second display values during a display period of the second image frame.

2. The method of claim 1, wherein the second image frame is a next consecutive image frame following the first image frame.

3. The method of claim 2, wherein the method is a method for displaying the sequence of image frames using weighted time segment bit-planes determined from incoming pixel imaging digital data codes; and wherein providing the first and second values comprises applying nominal values of incoming pixel imaging digital data codes to bit-plane formatting electronics.

4. The method of claim 3, wherein the offset values are chosen as a function of one or more of the pixel digital code, the pixel spatial location, and the pixel temporal location in time.

5. The method of claim 4, wherein the offsets are applied to the nominal pixel values over a repeating two-frame sequence.

6. The method of claim 5, wherein the offsets are applied to nominal pixel values within each frame as a function of spatial location on a spatial light modulator.

7. The method of claim 3, wherein the spatial pattern is dependent on the value of the pixel code involved in the major bit transition.

8. The method of claim 3, wherein in the spatial cluster, some pixels have values with the major bit set and some do not have the major bit set.

9. The method of claim 3, wherein the spatial pattern is a checkerboard pattern.

10. The method of claim 3, wherein the spatial pattern is a first spatial pattern and the spatial cluster is a first spatial cluster, further comprising:

for the first image frame, applying a second spatial pattern of offsets to the nominal values of pixels in a second spatial cluster of pixels located adjacent the first spatial cluster; and for the second image frame, applying the inverse of the second spatial pattern of offsets to the nominal values of the pixels in the second spatial cluster; so that the average values of the pixels in the second cluster of pixels over the first and second image frames are equal to the nominal pixel values.

11. The method of claim 10, wherein, one of the first and second clusters contains pixel values below the major bit and the other cluster contains pixel values above the major bit of the bit transition boundary dispersed.

* * * * *